United States Patent [19]

Allgäuer et al.

[11] Patent Number: 4,884,700

[45] Date of Patent: Dec. 5, 1989

[54] SORTING MACHINE

[75] Inventors: Günter Allgäuer, Uhldingen-Mühlhofen; Peter Strohhäcker, Ravensburg; Dieter Fuchs, Waldburg, all of Fed. Rep. of Germany

[73] Assignee: Maschinenfabrik Bezner GmbH & Co. KG, Ravensburg, Fed. Rep. of Germany

[21] Appl. No.: 113,447

[22] Filed: Oct. 28, 1987

[30] Foreign Application Priority Data

Oct. 28, 1986 [DE] Fed. Rep. of Germany ..... 3636650

[51] Int. Cl.[4] ..... B07B 13/05

[52] U.S. Cl. ..... 209/685; 209/692; 209/695; 209/691; 209/930

[58] Field of Search ..... 209/692, 685, 635, 684, 209/691, 695, 694, 930, 629

[56] References Cited

U.S. PATENT DOCUMENTS

| | | | |
|---|---|---|---|
| 460,436 | 9/1891 | Gray | 209/685 X |
| 1,675,049 | 6/1928 | Perkins . | |
| 1,834,658 | 12/1931 | Symonds . | |
| 2,116,006 | 5/1938 | Thys | 209/685 X |
| 2,788,895 | 4/1957 | Spence . | |
| 3,235,076 | 2/1966 | Snyder et al. | 209/692 |

FOREIGN PATENT DOCUMENTS

| | | | |
|---|---|---|---|
| 2928886 | 1/1980 | Fed. Rep. of Germany | 209/930 |
| 3415090 | 4/1984 | Fed. Rep. of Germany . | |
| 3607787 | 8/1987 | Fed. Rep. of Germany | 209/692 |
| 262844 | 5/1971 | U.S.S.R. | 209/692 |

*Primary Examiner*—Joseph J. Rolla
*Assistant Examiner*—David H. Bollinger
*Attorney, Agent, or Firm*—Spencer & Frank

[57] ABSTRACT

A sorting machine which serves for treatment of mixtures of refuse, especially household rubbish, trade waste, industrial waste, refuse from demolition, waste from building sites, and also waste from wood or the like. To achieve a drum-like motion, a mixture of useful material is supplied to a conveyor belt which is inclined transversely to the direction of transport, the conveyor belt having the shape of part of a cylindrical shell. For the production of a screen effect, the screen conveyor belt is provided with screen pockets on its surface, so that fine material falling into the screen pockets is transported in the longitudinal direction of the screen conveyor belt, and coarse material is transported in the transverse direction of the screen conveyor belt, and thereby they are separated.

18 Claims, 3 Drawing Sheets

SORTING MACHINE

BACKGROUND OF THE INVENTION

The invention relates to a sorting machine, especially for sorting mixtures of refuse, especially household rubbish, trade waste, industrial waste, refuse from demolition, waste from building sites, and also waste from wood or the like.

A sorting plant for sorting useful material has been published in the inventors' older German application No. 34 15 090 A1. In it, a sorting machine is disclosed which consists of a vibrating conveyor belt which is inclined transversely to the direction of conveying and rises in the direction of conveying, for separation of three-dimensional material to be sorted from two-dimensional material. There is no screening operation by means of a mesh.

The separation of dry waste, and sorting into individual components which can be re-utilized, causes great problems because of the severe entanglement of the waste that arrives. In particular, all types of screens tend to a greater or lesser extent to create blockages, because individual components can become stuck in the screening mesh. This is particularly the case for materials without any fixed structure or shape, such as stockings, scraps of cloth, string, and tape, which partly fall through the screening mesh and partly are retained by the remaining refuse. In this way the width of the mesh is automatically reduced.

For this reason, screening devices with meshes, or of screen form of any kind, can only be introduced into the treatment of refuse to a limited extent and with special measures. For this reason the way of separating materials is more or less restricted. Drum screens have indeed the advantage that the material introduced is continuously thrown on top of itself by the rotation, and hence is pulled apart. Nevertheless, drum screens are not suitable for sorting refuse, for again the meshes tend strongly to blockage by refuse components. Moreover the support and drive construction of drum screens needs axial space, which may be undesired.

From the totally foreign field of the sorting of hops, a device has been disclosed in U.S. Pat. No. 2,116,006, which consists of a circulating conveyor belt, that has a multiplicity of pockets. The operation of separation of the hop from the hop stem occurs by a brush shearing off and flinging away the hop stems projecting out of the pockets. On return of the belt, the remaining portions of hop fall into a container provided.

This device is not suited to the sorting of refuse, because a separating operation by means of a brush device is not possible. Moreover the pocket shape of the conveyor belt has merely the function of a holder for getting rid of the stems which stick up above it.

SUMMARY OF THE INVENTION

The object underlying the invention is to provide a sorting machine for the treatment of refuse, which in particular permits separation and sorting, as far as possible free of blockages, of mixtures of refuse, especially household rubbish, trade waste, industrial waste, and the refuse which is particularly difficult to handle from demolition of buildings, waste from building sites, and also waste from old timber.

Starting from a sorting machine of the kind indicated in the introduction, this object is achieved according to the invention with a circulating endless conveyor device which is inclined transversely to the direction of movement, wherein the mixture of recoverable material can be supplied in the region of the upper lateral edge of the conveyor device formed as a screen conveyor belt, coarser material to be sorted being able to be transported in the transverse direction of the screen conveyor belt by gravity and/or vibration, and finer material to be sorted being able to be transported in the longitudinal direction of the screen conveyor belt by means of screen pockets provided on the screen conveyor belt.

The invention operates firstly according to the principle of separated bulk flow of material in the longitudinal and transverse direction of a conveyor device. For this purpose the mixture of useful material to be sorted is supplied onto one side of an inclined conveyor belt and can cross over the circulating conveyor belt transversely to the direction of travel, under the action of gravity and/or assisted by vibration or oscillation. One part of the mixture of useful material falls into the screen pockets provided on the screen belt and is carried along in the longitudinal direction of transport of the conveyor device, until the screen pockets tip over on the return roller. The screen pockets thus constitute an aperture screen, but with limited height for falling through. In this way the whole screen system is practically free from blockage.

According to the invention the screen device is so constructed that, in the region of the screening run, the conveyor belt is formed like a drum screen, i.e. the conveyor belt is directed sagging in an arc like a cylindrical shell. By this means the mixture of useful material transported on this drum-like screen is continuously turned over, which leads to loosening up and separation of the constituents. The drum-like effect of the transporting screen belt, which would normally be flat, is achieved in that the longitudinal axes of the return rollers are journalled at a higher level than the lowest point on the transport/treatment surface. By these means, the sorting machine according to the invention works with the advantageous effects of a drum screen, without its disadvantages as regards the tendency to blockage, nor the need to keep in mind the unfavourable constructional length. The device according to the invention can make full use in the input and output region of the additional axial length as compared with conventional screens.

Furthermore, the formation of the screen pockets according to the invention is particularly advantageous in that, upon the returning motion over the upper return roller, they open automatically, and hence enable perfect emptying of the screen pocket. Each individual rear wall, which is common to two successive screen pockets, is tipped away from one pocket during the returning motion, so that an opening occurs in this region.

BRIEF DESCRIPTION OF THE DRAWINGS

Further features and advantages which are important to the invention appear from the following exemplary embodiments, which are described in more detail with reference to the drawings in which.

DESCRIPTION OF THE PREFERRED EMBODIMENTS

Figure 1:
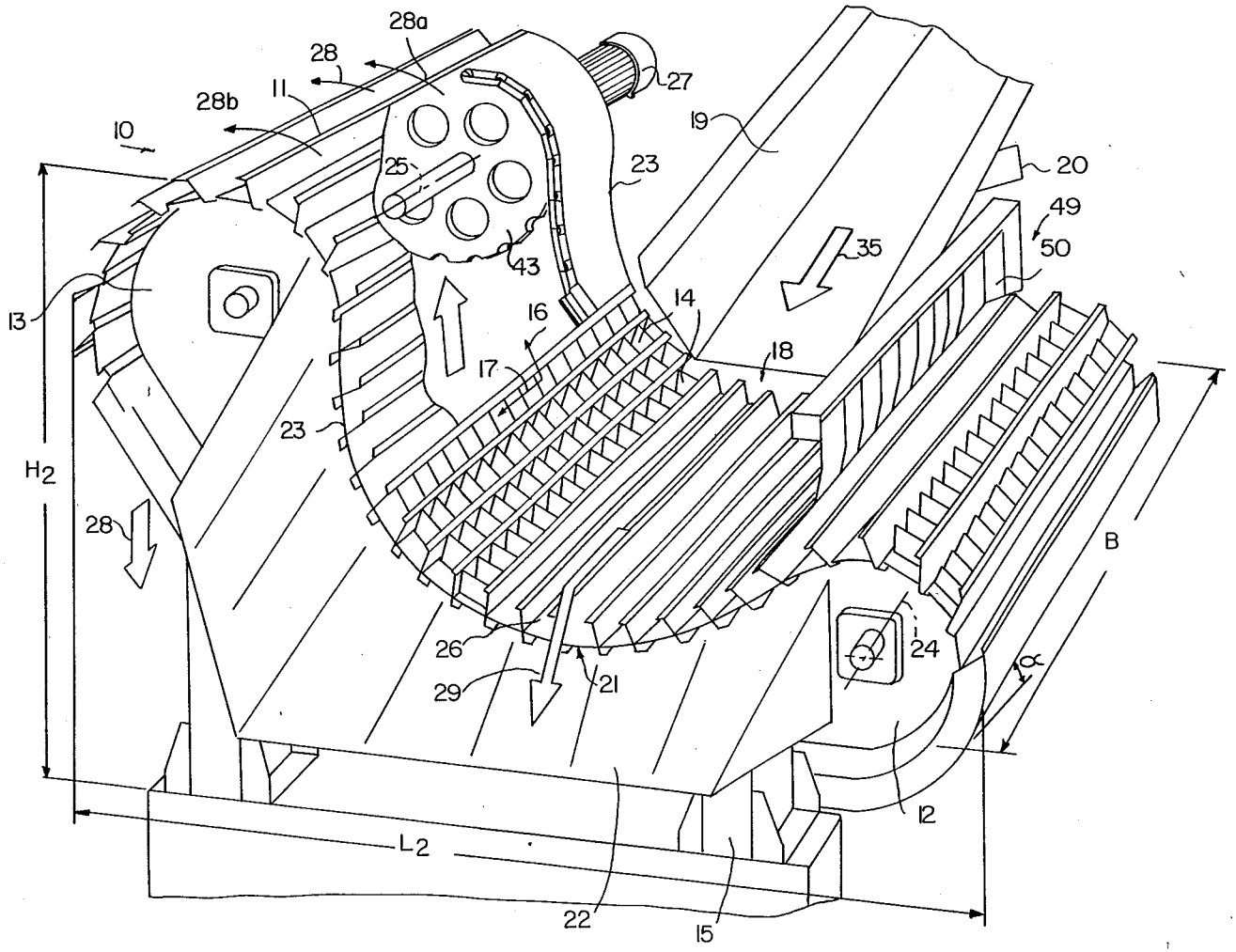
FIG. 1 is a perspective view of a sorting machine according to the invention, shown schematically.

The sorting machine (10) shown in FIG. 1 consists of a circulating, endless conveyor device with a lower return roller (12) and an upper return roller (13). The conveyor device is formed as a screen conveyor belt (11), with screen pockets (14) provided on it, arranged in a layout side-by-side and one behind the other. In FIG. 1 the screen pockets are only shown schematically, in selected places on the screen conveyor belt. The screen conveyor belt (11) is fitted with such screen pockets all over its transporting surface.

The screening machine (10) stands on a base frame (15), the screen conveyor belt (11) being designed inclined across the direction (16) of movement at an angle ($\alpha$). The longitudinal direction of the screen conveyor belt is indicated by the reference character (16), and the transverse direction of the screen conveyor belt by the reference character (17).

In the region of the higher lateral edge (18) of the screen conveyor belt (11) there is shown the supply device (19) in the form of a chute with oscillating drive (20); for the mixture (32) of useful material which is to be supplied to the sorting machine. On the opposite, lower lateral edge (21) there is shown the discharge device (22) for the coarse material (29).

The return rollers (12 and 13) for the screen conveyor belt (11) are so arranged in relation to the arrangement and length of the screen conveyor belt that, in the region of the conveyor run for the material to be transported, a construction results which is like a drum screen. For this purpose the transporting surface for the material to be sorted travels along a cylindrical shell (23). The radius of curvature of this cylindrical shell is chosen according to the material to be treated. The drum-like construction in the conveying region is attained by placing the longitudinal axes (24 and 25) of the return rollers (12 and 13) at a higher level in relation to the lowest point (26) on the screen conveyor belt. In the exemplary embodiment in FIG. 1, the longitudinal axis (25) of the return roller (13) is arranged spatially higher than the longitudinal axis (24) of the return roller (12).

This produces the steep rising inclination of the screen conveyor belt (11) and also the drum-like construction for continuous turning over of the mixture of useful material on it.

The drive of the return roller (13), and hence of the screen conveyor belt (11), is indicated as the driving motor (27), the drive taking place via a chain drive (43), which is covered by the conveyor belt (11).

The transport of material transversely to the longitudinal direction (16) of the screen conveyor belt, i.e. in the transverse direction (17) of the screen conveyor belt, takes place as a result of the inclination of the screen conveyor belt (11) through the angle ($\alpha$). The angle ($\alpha$) is chosen in the range of magnitude between 5° and 20° as in drum screens. It can however also assume other values according to the material composition of the mixture of useful material to be sorted. Accordingly, the transport of material is effected by gravity, as in a drum screen with material-turning properties. Additionally or alternatively an oscillating drive or a shaking drive can also be provided for the screen conveyor belt (11).

The screen pockets (14) provided over the whole surface of the screen conveyor belt (11) constitute a kind of aperture screen into which finer screened material falls and is carried onwards in the longitudinal direction (16) of the screen conveyor belt. The fine material (28) does not fall out as a separate sorted fraction until the returning motion over the return roller (13). On the other hand, the material that is too large for the screen pockets (14) is carried onwards in the transverse direction (17) of the screen conveyor belt, and is carried off in the discharge device (22) as coarse material (29). In order to ensure a sufficient residence time of the mixture of useful material on the screen conveyor belt (11), the latter must have a certain minimum width (B), which corresponds to the length of a drum-screen device including supporting structure. The width (B) lies in the order of magnitude of $B \simeq 4$ m.

The screen pockets (14) arranged on the screen conveyor belt can, as regards their pocket size, be made either all of equal size or of differing size. Thus it would be possible to arrange coarser pockets in the region of the supply device (19) and finer screen pockets in the region of the discharge device (22), in order to take account of the continuous loosening and separation of the mixture of useful material during the screening operation. Then different sized fractions could be taken off as a course fraction (28*a*) and as a fine fraction (28*b*) in the region of the return roller (13). The screen pockets (14) can also be formed as longitudinal channels, with a longitudinal extent in the direction of the transverse direction (17) of the screen conveyor belt. Then for example elongated objects, such as sticks and planks etc., can be received into these channels. In addition in FIG. 1 there is shown a deflecting wall (50) with a flexible curtain (51), e.g. made of a chain curtain or the like. This deflecting wall restrains material that is thrown backwards by the drum effect.

Figure 2A:
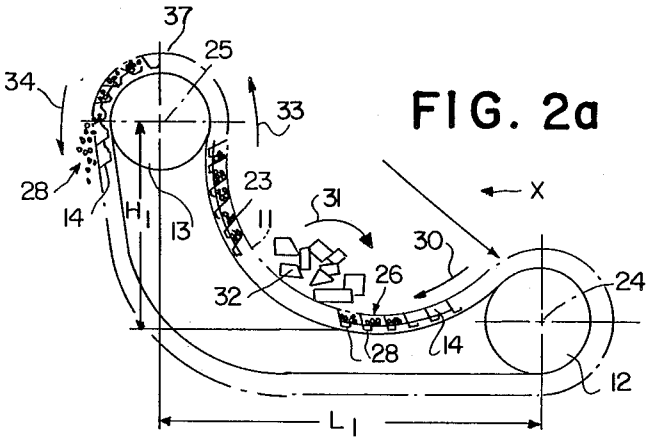
FIG. 2*a* is a longitudinal section in the direction of transport through the view in FIG. 1.

The longitudinal section through the longitudinal direction of the screen conveyor belt, shown in FIG. 2*a* shows clearly the construction and the action of the screen conveyor belt (11) like a drum screen. The cylindrical shell (23) extends over nearly a complete semicircle with the radius (r). The transport direction of the screen conveyor belt (11) in the longitudinal direction of the screen conveyor belt is indicated by an arrow (30). An arrow (31) indicates the turning over action of the mixture (32) of useful material, caused by the drum screen effect. The fine material (28) is collected in the screen pockets (14) and is transported in the direction of the arrow (33) to the upper return roller (13) and is carried round it. In the region of the transport arrow (34), the fine material (28) tips out of the rotating and opening screen pockets (14).

The longitudinal axis (25) of the upper return roller (13) is at a height ($H_1 \simeq 2.1$ to 2.4 m) above the longitudinal axis (24) of the return roller (12). In conjunction with the lateral length ($L_1 \simeq 5.1$ m), this height ($H_1$) determine the radius of curvature (r) of the screen conveyor belt (11) resembling a drum screen. In the exemplary embodiment in FIG. 2*a*, the lowest point (26) of the screen conveyor belt is at about the same level as the longitudinal axis (24) of the return roller (12). The total length ($L_2$) shown in FIG. 1 amounts to about $L_2 \simeq 7.2$ m, the lateral length ($L_1 \simeq 5.1$ m), this height ($H_1$) determines and the total height ($H_2$) of the screen conveyor device without the support frame (15) amounts to about $H_2 \simeq 5.2$ m.

Figure 2B:
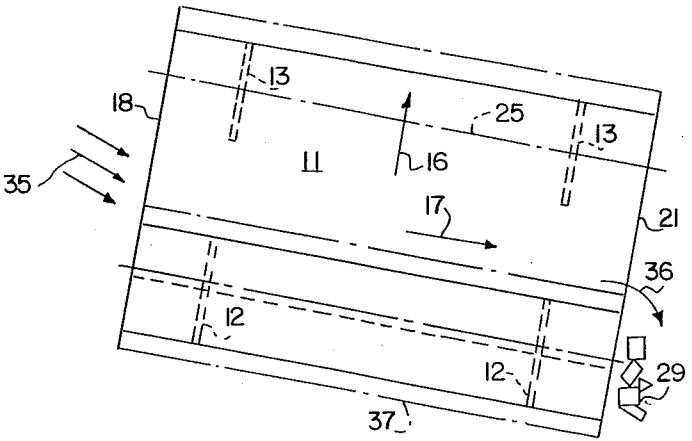
FIG. 2*b* is the view x in FIG. 2*a*.

In FIG. 2*b* there is shown the view "X" in FIG. 2*a*. According to it, the mixture (32) of useful material is supplied to the screen conveyor belt (11) at the laterally upper edge (18) (arrow 35) (see also FIG. 1). The mixture of useful material then travels in the direction of the transverse direction (17) of the screen conveyor belt, because of the inclination of the screen conveyor belt (11) and because of the further transport in the drum-like device, the coarse material (29) being discharged at the edge (21) opposite to the lateral edge (18) (arrow 29, 36), while the fine material is conveyed in the longitudinal direction (16) of the screen conveyor belt by the screen pockets (14). The arrows (30, 33) shown in FIG. 2*a* are directed along the longitudinal direction (16) of the screen conveyor belt. The lower return roller (12) and the upper one (13) are shown schematically in FIG. 2*b*. The chain lines (37) in FIG. 2*b* correspond to those in FIG. 2*a* and indicate and external radius of the screen pockets running over the return rollers (12, 13).

Figure 3:
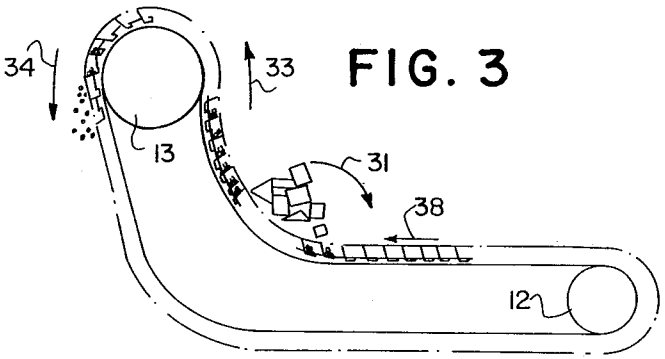
FIG. 3 is a sectional view similar to FIG. 2*a* of an alternative embodiment.

The exemplary embodiment according to FIG. 3 shows a variant of the embodiment in FIG. 2*a*. By a modified arrangement or shape of the lower return roller (12), a screen conveyor belt is provided which is at first flat in the region of the arrow (38). This can if necessary have the advantage that the supply of the mixture of useful material and corresponding distribution on the conveyor belt can take place over a longer supporting range.

But in principle this screen conveyor belt works in the same way as has already been shown in FIGS. 1 and 2*a*. The same items are indicated with the same reference characters.

Figure 4A:
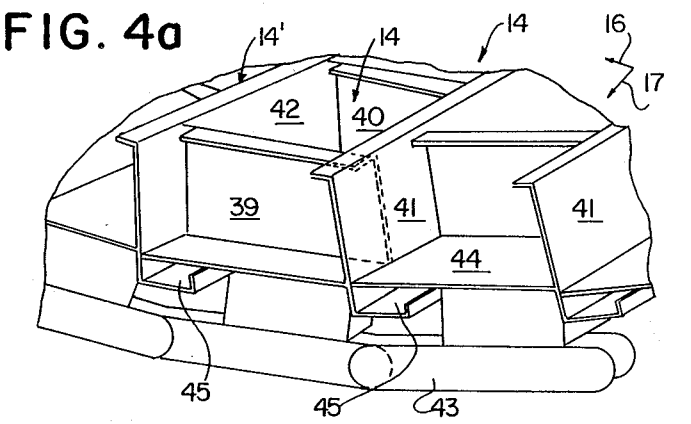
FIG. 4*a* is a perspective view of the shapes of screen pockets in the region of the drum screen cross-section.
Figure 4B:
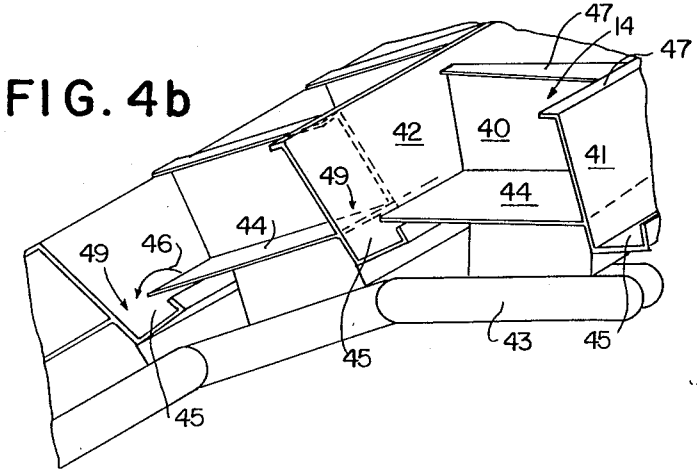
FIG. 4*b* is a perspective view of the screen pockets in the region of the return rollers.

In FIGS. 4*a* and 4*b* there is shown the construction of the screen pockets (14) and also the arrangement in different conditions of operation. Each screen pocket (14) consists of two side walls (39, 40) in the longitudinal direction (16) of the screen conveyor belt, and also two transverse walls (41, 42) in the transverse direction (17) of the screen conveyor belt. The longitudinal walls (39, 40) together with the transverse wall (41) form a container enclosed on three sides, while the fourth side wall (42) in each case is constituted by the rear wall (41) of the next-following screen pocket. For this reason, in FIG. 4*a* the screen pocket (14) for example is constituted by the walls which are connected rigidly together (39 to 41), while the transverse wall (42) is formed by the following screen pocket (14').

As shown in FIG. 4*a*, the transverse wall (42) which is movable relative to the screen pocket (14) fits closely against the side walls (39, 40) and forms a closed container. This condition occurs in the region of the drum-like shape with a radius of curvature (r). For this reason, the schematically-shown chain conveyor (43) is designed so as to be bent in FIG. 4*a* in the shape of a drum screen.

In the region of the return rollers (11, 12) the chain conveyor (43) is bent round in the opposite direction to that in the drum screen region, so that the screen pockets (14) open by swinging away of the transverse wall (42). Hence the volume of the screen pockets is increased in the region of the bending of the return roller (13), so that the contents can fall out still more easily.

The opening and closing of the transverse walls (42) occur as the chain conveyor (43) bends since the respective floors (44) of each the pockets (14) are connected to the pivotally connected sections of the conveyor (43) as shown for example in FIGS. 4*a* and 4*b*.

So that no fine material can fall out between the tipping away transverse wall (42) and the container (14) consisting of the walls (39 to 41), the transverse walls (41, 42) are formed as a U-shaped trap (45) in their region below the floor (44). Parts (arrow 46) sliding off from the screen pocket floor (44) are therefore caught in the U-shaped recess (45) and cannot lead to sticking of the chain conveyor (43).

The side walls (39, 40) and transverse walls (41, 42) can also have additional flanges (47) in their upper region, for stiffening the screen pocket and for avoiding pieces sliding out.

Figure 5A:
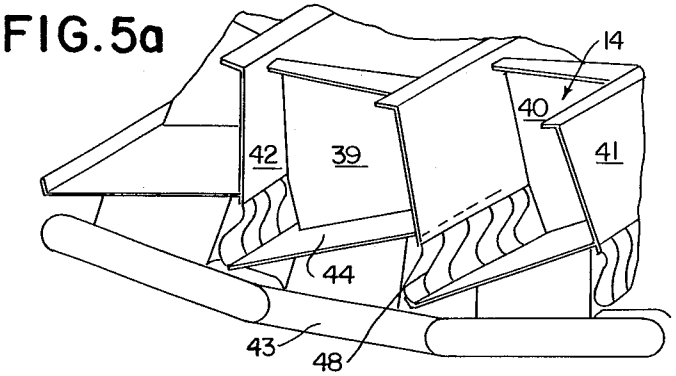
FIG. 5*a* and 5*b* are perspective views similar to FIGS. 4*a* and 4*b* of alternative embodiments of the screen pockets with resilient intermediate strips between the pockets.
Figure 5B:
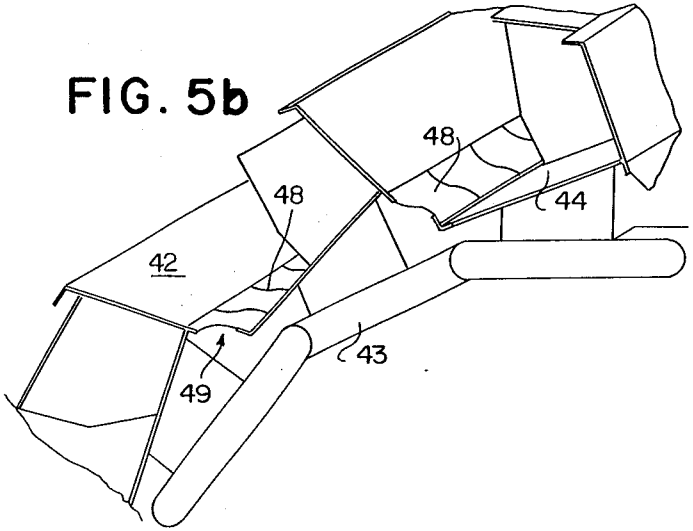

An alternative embodiment of the screen pocket in FIGS. 4*a* and 4*b* is shown in FIGS. 5*a* and 5*b*. In place of the U-shaped trap (45) there is provided a flexible connecting strip (48) between the screen pocket floor (44) and the lower part of the transverse wall (42) which can be tipped away. The movable transverse wall (42) fits against the side walls (39, 40) in the region of the drum-like formation or flat formation of the screen conveyor belt (11). Only when the chain conveyor (43) moves around the return rollers (12, 13) does the screen pocket (14) open, and the transverse wall (42), which forms the rear wall of the next-following screen pocket, swing away from the screen pocket. The opening (49) which results from this is closed by the flexible connecting strip (48).

For the formation of larger screen pockets (14), several side walls (39, 40) can be omitted, so that a kind of transverse channel is produced, extending in the transverse direction (17) of the screen conveyor belt.

The invention is not limited to the exemplary embodiments shown and described. Rather, it includes all constructions which would be known to an expert, and developments without inventive content.

We claim:

1. A sorting machine for separation and sorting of a mixture of fine and coarse solid waste materials, comprising:

first and second return rollers at opposite longitudinal ends of the machine, horizontally spaced apart in a longitudinal direction: and a conveyor belt having an exposed outer surface defined between first and second transversely spaced edges, trained over said first and second rollers so as to sag in a portion between said first and second rollers adjacent said first roller, said outer surface having open pocket-like recesses therein, the sagged portion of said conveyor belt being sufficiently steep and deep and said recesses being so shaped as to respectively form a means for repeatedly turning over the coarse material and a means for carrying away the fine material, when the mixture of fine and coarse material is provided onto said belt at said first edge and said belt is moved across said rollers in said longitudinal direction from said second roller toward said first roller, said outer surface declining in a transverse direction extending from said first edge to said second edge, the decline of said outer surface in said transverse direction serving to aid by gravitational force, movement of the coarse material in said transverse direction across said surface in said sagged portion and over said second edge.

2. A sorting machine as in claim 1, wherein said first and second rollers having parallel axes of rotation, the axis or rotation of said first roller being higher than a lowest point of said sagged portion by about 210 to 240 cm.

3. A sorting machine as in claim 2, wherein said sagged portion includes a arcuate transport zone having a substantially constant radius of curvature, forming said means for repeatedly turning over the coarse material.

4. A sorting machine as in claim 3, wherein said outer surface includes a flat surface portion between said second roller and said sagged portion.

5. A sorting machine as in claim 2, wherein said outer surface includes a flat surface portion between said second roller and said sagged portion.

6. A sorting machine as in claim 1, wherein the distance between said first and second edges is approximately 4 meters and the angle of the incline of said upper surface in said transverse direction is in the approximate range of 5 to 20 degrees with respect to the horizontal plane.

7. A machine as in claim 1, wherein each recess comprises a container having three rigidly connected walls and a floor surface disposed at a bottom end and between said three walls, two of said three walls extending in said longitudinal direction and the third of said three walls comprising a transverse wall extending transversely to said two of said three walls, the transverse wall of a next following recess forming a transverse rear wall of the previous recess and being swingable away from said previous recess.

8. A machine as in claim 7, wherein the transverse walls of the recess have lower ends below the floor surfaces, shaped to form U-shaped traps for bridging an opening which is produced when the respective transverse walls swing away from a respective recess.

9. A machine as in claim 8, wherein said three walls are each bent at an angle at upper ends thereof.

10. A machine as in claim 7, wherein each recess further comprises a flexible connecting strip connecting a bottom end of the respective transverse wall and said floor surface so as to close an opening which is produced when the respective transverse wall swings away from the recess.

11. A machine as in claim 10, wherein said three walls are each bent at an angle at upper ends thereof.

12. A machine as in claim 1, further comprising a chain conveyor drive, coupled to and covered by said belt for driving said belt in a loop over said first and second rollers.

13. A sorting machine as in claim 1, wherein said open pocket-like recesses include a longitudinally and transversely extending array of open pocket-like recesses forming receiving pockets for carrying the fine material.

14. A sorting machine for separation and sorting of a mixture of fine and coarse solid waste materials, comprising:

first and second return rollers at opposite longitudinal ends of the machine, horizontally spaced apart in a longitudinal direction;

a conveyor belt having an exposed outer surface defined between a first and second laterally spaced edges, trained over said first and second rollers so as to sag steeply in a portion between said first and second rollers adjacent said first roller, said outer surface declining in a lateral direction extending from said first edge to said second edge, said outer surface having open pocket-like recesses therein, the sagged portion of said conveyor belt being sufficiently steep and deep and said recesses being so shaped as to respectively form a means for repeatedly turning over the coarse material and a means for carrying away the fine material, when the mixture of fine and coarse material is provided onto said belt at said first edge and said belt is moved across said rollers in said longitudinal direction from said second roller toward said first roller, the decline of said outer surface in said lateral direction serving to aid by gravitational force, movement of the coarse material in said transverse direction across said surface in said sagged portion and over said second edge, each recess comprising a container having three rigidly connected walls and a floor surface disposed at a bottom end and between said three walls, two of said three walls extending in said longitudinal direction and the third of said three walls comprising a transverse wall extending transversely to said two of said three walls, the transverse wall of a next-following recess forming a transverse rear wall of the previous recess and being swingable away from said previous recess.

15. A machine as in claim 14, wherein the transverse walls of the recesses have lower ends below the floor surfaces, shaped to form U-shaped traps for bridging an opening which is produced when the respective transverse walls swing away from a respective recess.

16. A machine as in claim 15, wherein said three walls are each bent at an angle at upper ends thereof.

17. A machine as in claim 14, wherein each recess further comprises a flexible connecting strip connecting a bottom end of the respective transverse wall and said floor surface so as to close an opening which is produced when the respective transverse wall swings away from the recess.

18. A machine as in claim 17, wherein said three walls are each bent at an angle at upper ends thereof.

* * * * *